US011482782B2

(12) United States Patent
Lee et al.

(10) Patent No.: US 11,482,782 B2
(45) Date of Patent: Oct. 25, 2022

(54) ANTENNA DEVICE

(71) Applicant: DENSO CORPORATION, Kariya (JP)

(72) Inventors: Jungaun Lee, Kariya (JP); Sho Matsumoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 29 days.

(21) Appl. No.: 17/155,947

(22) Filed: Jan. 22, 2021

(65) Prior Publication Data

US 2021/0257735 A1 Aug. 19, 2021

(30) Foreign Application Priority Data

Feb. 19, 2020 (JP) ..... JP2020-026492

(51) Int. Cl.
*H01Q 1/48* (2006.01)
*H01Q 5/50* (2015.01)

(52) U.S. Cl.
CPC ..... *H01Q 5/50* (2015.01); *H01Q 1/48* (2013.01)

(58) Field of Classification Search
CPC ..... H01Q 1/44; H01Q 1/48; H01Q 1/243; H01Q 9/0421; H01Q 9/0442; H01Q 9/0471; H01Q 5/50; H01Q 19/106
See application file for complete search history.

(56) References Cited

U.S. PATENT DOCUMENTS 6,297,776 B1 * 10/2001 Pankinaho ..... H01Q 1/48 343/846
6,903,687 B1 * 6/2005 Fink ..... H01Q 9/0407 333/126
2004/0201523 A1 * 10/2004 Yuanzhu ..... H01Q 1/3275 343/700 MS
2005/0134460 A1 6/2005 Usami
2005/0174291 A1 * 8/2005 Inatsugu ..... H01Q 21/29 343/700 MS
2005/0235482 A1 * 10/2005 Deaett ..... H01P 11/00 343/700 MS
2010/0127940 A1 5/2010 Harihara et al.
2018/0151955 A1 * 5/2018 Zhang ..... H01Q 5/371
2019/0207301 A1 7/2019 Shimura
2021/0167507 A1 * 6/2021 Yamada ..... H01Q 5/335

FOREIGN PATENT DOCUMENTS

JP 2003-143030 A 5/2003
JP 2012-253649 A 12/2012
JP 2013-239956 A 11/2013
JP 2016-181755 A 10/2016
JP 2020-010135 A 1/2020

* cited by examiner

*Primary Examiner* — Tung X Le
(74) *Attorney, Agent, or Firm* — Posz Law Group, PLC

(57) ABSTRACT

An antenna device is a device of 0th-resonance antenna, which includes: a ground plate providing a ground potential; an opposed conductor arranged to have a predetermined distance from the ground plate in a plate thickness direction of the ground plate and configured for connection to a feeder line; and a short-circuit part electrically connecting the opposed conductor and the ground plate. The antenna device further includes an intermediate conductor having a same potential as the ground plate and arranged in between the ground plate and the opposed conductor in the plate thickness direction. The intermediate conductor includes a penetration part that includes the opposed conductor in a plan view in the plate thickness direction.

9 Claims, 11 Drawing Sheets

ANTENNA DEVICE

CROSS REFERENCE TO RELATED APPLICATION

The present application is based on and claims the benefit of priority of Japanese Patent Application No. 2020-026492, filed on Feb. 19, 2020, the disclosure of which is incorporated herein by reference.

TECHNICAL FIELD

The present disclosure generally relates to an antenna device.

BACKGROUND INFORMATION

A conventional antenna device includes a 0th-order resonance antenna using metamaterial technology. The 0th-order resonance antenna has a narrow band (i.e., narrow frequency bandwidth). Further improvements are required.

SUMMARY

It is an object disclosed of the present disclosure to provide a wide band antenna device.

One embodiment includes: a ground plate that provides a ground potential; an opposed conductor arranged to have a predetermined distance from the ground plate in a plate thickness direction of the ground plate and have a feeding point; a short-circuit part electrically connecting the opposed conductor and the ground plate; and an intermediate conductor having a same potential as the ground plate and arranged in between the ground plate and the opposed conductor in the plate thickness direction.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Figure 1:
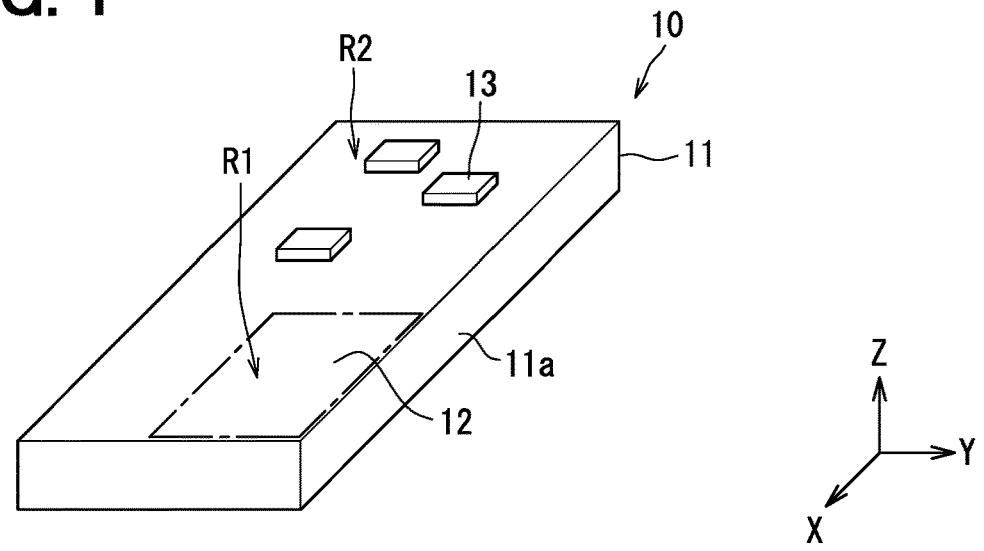
FIG. 1 is a perspective view showing an electronic device to which an antenna device is applied.

Hereinafter, embodiments are described with reference to the drawings.

In each of the embodiments, parts that are functionally and/or structurally corresponding to each other are given the same reference numerals.

First Embodiment

First, a schematic configuration of an electronic device to which the antenna device is applied is described with reference to FIG. 1. The electronic device is, for example, an electronic control unit (ECU) mounted on a movable body such as a vehicle. ECU is an abbreviation for Electronic Control Unit.

Electronic Control Unit

As shown in FIG. 1, an electronic device 10 includes a circuit board 11. The circuit board 11 has a wiring board in which wiring is arranged on an insulating base board material, and an electronic component mounted on the wiring board to form a circuit together with the wiring. The circuit board 11 is housed in, for example, a housing or a case (not shown). In the following, the thickness direction of the circuit board 11 (i.e., the wiring board) is the Z direction. Further, one direction orthogonal to the Z direction is defined as the X direction, and the Z direction and the direction orthogonal to the X direction are defined as the Y direction.

A region R1 which is a part of the circuit board 11 provides a wireless communication function. A wireless communication unit 12 is formed in the region R1. The region R1 is a part surrounded by an alternate long and short dash line (or a one-dot broken line) in a plan view in the Z direction. The region R1 is a region including one corner of the circuit board 11 having a substantially rectangular shape in a plan view in the Z direction. The region R1 includes a part of a side surface 11*a* of the circuit board 11 in the Y direction. Hereinafter, the side surface 11*a* may also be referred to as a board end part 11*a*. The wireless communication unit 12 includes an antenna device 20 described later and a power feeding circuit (i.e., a communication circuit).

As described above, the electronic device 10 has a built-in wireless communication unit 12. For example, the electronic device 10 can perform wireless communication with other electronic devices arranged in the vehicle. The other electronic device may be arranged outside a housing that accommodates the circuit board 11, or may be housed in the same housing as the electronic device 10. The electronic device 10 may be configured to perform wireless communication with the outside of the vehicle.

In the circuit board 11, an electronic component 13 is mounted in a region R2, which is the remaining part excluding the region R1, to form a circuit. The region R2 provides the ability to perform control over the vehicle. The region R2 is larger than the region R1 in the plan view in the Z direction. A processor, a memory, and the like (not shown)

are mounted in the region R2. The memory here is a storage device or is, e.g., at least one type of non-transitory, tangible storage medium such as a semiconductor memory, a magnetic medium, an optical medium, or the like for storing or memorizing a computer-readable program, data, or the like. The processor includes, as its core, for example, at least one of CPU (Central Processing Unit), GPU (Graphics Processing Unit), RISC (Reduced Instruction Set Computer) -CPU, and the like.

The processor performs various processes for realizing the function according to the program stored in the memory. For example, at least one of the processing results is transmitted to another electronic device by wireless communication. For example, the processor uses information acquired from another electronic device by wireless communication and performs processing according to the above program. The processor and memory are provided, for example, as a microcomputer/microcontroller which is one electronic component.

A power supply circuit and the like are also formed in the region R2 of the circuit board 11.

Structure of Antenna Device

Figure 2:
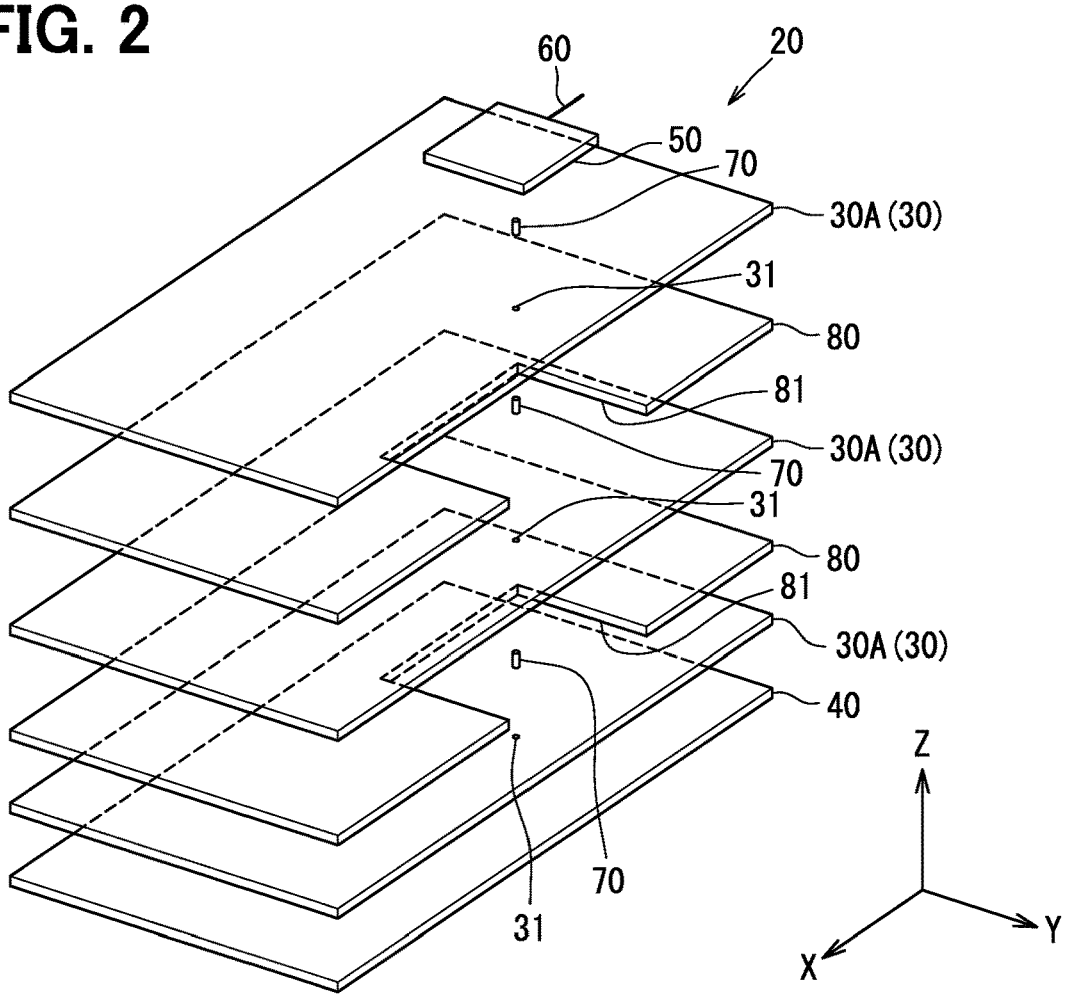
FIG. 2 is an exploded perspective view showing the antenna device according to the first embodiment.
Figure 3:
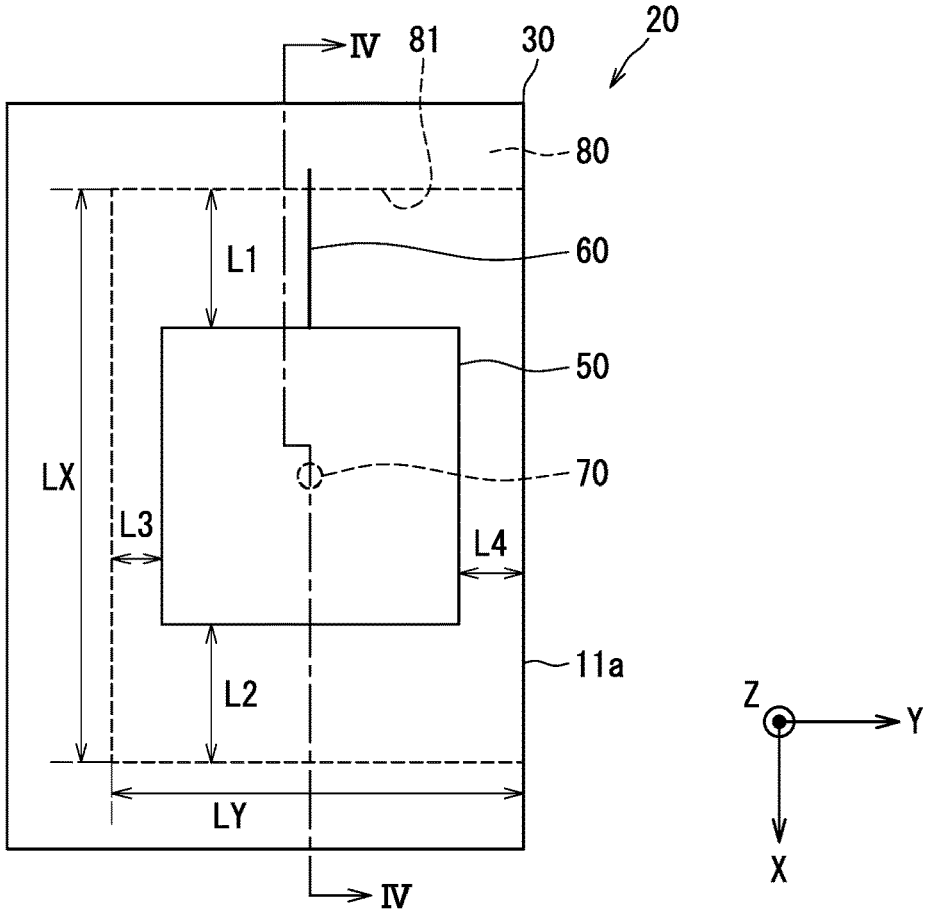
FIG. 3 is an enlarged plan view of a proximity of an opposed conductor.
Figure 4:
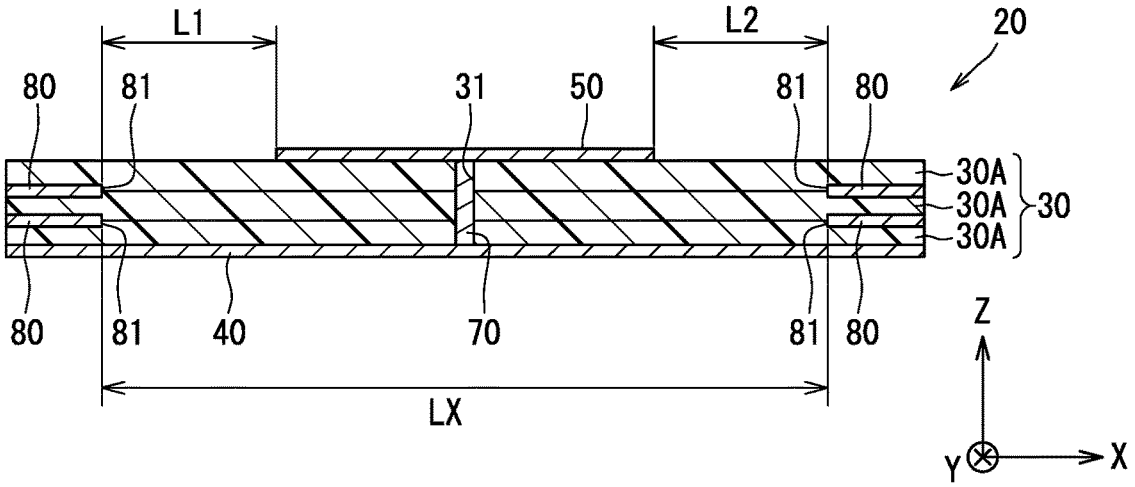
FIG. 4 is a cross-sectional view taken along a line IV-IV of FIG. 3.

Next, the structure of the antenna device is described with reference to FIGS. 2, 3, and 4. FIG. 2 is an exploded perspective view of the antenna device. FIG. 3 is an enlarged plan view of a proximity of the opposed conductor as viewed from an opposed conductor side. FIG. 4 is a cross-sectional view taken along a line IV-IV of FIG. 3.

The antenna device 20 is configured to transmit and/or receive radio waves having a predetermined operation frequency. An example of the operation frequency is 2.44 GHz. The antenna device 20 is configured to be able to transmit and/or receive radio waves in a frequency band used in a short-range wireless communication. The operation frequency may be appropriately designed, and may be other frequency other than 2.44 GHz (for example, may be 5 GHz).

The antenna device 20 of the present embodiment is formed on the circuit board 11. In other words, the antenna device 20 is realized by using the circuit board 11. The antenna device 20 is provided in the vicinity of one side surface in the Y direction (rightward in FIGS. 1, 2, and 3) of the circuit board 11.

As shown in FIGS. 2 to 4, the antenna device 20 includes a base material 30, a ground plate 40, an opposed conductor 50, a feeder line 60, a short-circuit part 70, and an intermediate conductor 80. In the following, for convenience, the direction from the ground plate 40 to the opposed conductor 50 is defined as upward (in a positive Z direction), and the direction from the opposed conductor 50 to the ground plate 40 is defined as downward (in a negative Z direction). FIG. 3 is a planer view (a bird's eye view, in a negative Z direction), with the Z direction coming up out of the paper. FIG. 4 is a side view in a positive Y direction (equivalent to from left to right in FIG. 3).

The base material 30 corresponds to an insulating base board material constituting the circuit board 11 (i.e., wiring board). The antenna device 20 is configured in the region R1 of the base material 30. The base material 30 is made of a dielectric material such as resin. By using the base material 30, the wavelength shortening effect of the dielectric material can be expected. As the base material 30, for example, a material made only of resin, or a combination of resin and glass cloth, non-woven fabric, or the like can be adopted.

The facing distance between the ground plate 40 and the opposed conductor 50 and the length of the short-circuit part 70 can be adjusted by adjusting the thickness of the base material 30. The base material 30 functions as a holding part that holds the ground plate 40 and the opposed conductor 50 in a predetermined positional relationship (i.e., apart from each other). The base material 30 has a multi-layer structure. The base material 30 of the present embodiment is a laminated body formed by laminating three thin plates 30A provided as a dielectric material. The thin plate 30A is not limited to a sheet shape, but may be a film shape.

The ground plate 40 is a flat plate-shaped conductor made of copper or the like. The plate thickness direction of the base plate 40 is substantially parallel to the Z direction, which is the plate thickness direction of the circuit board 11. The direction perpendicular to (normal to) the plate surface of the ground plate 40 is also substantially parallel to the Z direction. Hereinafter, the shape of the ground plate 40 viewed in a plane from the plate thickness direction, that is, the Z direction is simply referred to as a plane shape.

The ground plate 40 has a size that includes the entire opposed conductor 50 and a penetration part 81 (or penetration cut-out), which is described later, in a plan view. The ground plate 40 has, for example, a substantially rectangular shape in a plane. The ground plate 40 of the present embodiment is arranged on the lower/bottom surface of the base material 30. The ground plate 40 is formed by patterning a metal foil arranged on one surface of a thin plate 30A forming the lower surface of the base material 30. The ground plate 40 is connected to a feeding circuit (not shown) to provide a ground potential in the antenna device 20.

The opposed conductor 50 is a plate-shaped conductor made of copper or the like. The opposed conductor 50 is a conductor arranged to face/oppose the ground plate 40 so as to have a predetermined distance from the ground plate 40 in the Z direction. The opposed conductor 50 may be referred to as a patch part or a radiating element. In a plan view, the entire opposed conductor 50 overlaps the ground plate 40. That is, the entire plate surface (lower surface) of the opposed conductor 50 faces the ground plate 40 in the Z direction. The opposed conductor 50 is arranged substantially parallel to the ground plate 40. The opposed conductor 50 of the present embodiment is arranged on the upper surface of the base material 30. The opposed conductor 50 is formed by patterning a metal foil arranged on one surface of a thin plate 30A forming the upper surface of the base material 30. The opposed conductor 50 has a flat square shape. As the side part defining the square, the opposed conductor 50 has a side part substantially parallel to the X direction and a side part substantially parallel to the Y direction.

The opposed conductor 50 is electrically connected to the feeding circuit via the feeder line 60. The feeder line 60 of the present embodiment includes a conductor arranged on the upper surface of the base material 30. Such a conductor may also be referred to as a microstrip line. One end of the feeder line 60 is connected to one of the four sides of the opposed conductor 50. A connecting part of the feeder line 60 on the opposed conductor 50 corresponds to a feeding point. The current input from the feeding circuit to the feeder line 60 propagates to the opposed conductor 50 and excites the opposed conductor 50. The power supply method is not limited to the direct power supply method. A feeding method in which the feeder line 60 and the opposed conductor 50 are electromagnetically coupled may also be adopted.

The short-circuit part 70 electrically connects the ground plate 40 and the opposed conductor 50, that is, short-circuits the two. The short-circuit part 70 is a columnar conductor having one end connected to the ground plate 40 and the other end connected to the opposed conductor 50. The short-circuit part 70 of the present embodiment is composed of a via conductor formed on the circuit board 11 (i.e., wiring board). As described above, the base material 30 (thin plate 30A) has a through hole 31. Then, the short-circuit part 70 is formed by a conductor arranged in the through hole 31.

The short-circuit part 70 is connected to substantially the center of the opposed conductor 50 in a plan view. The center of the opposed conductor 50 corresponds to the center of gravity of the opposed conductor 50. Since the opposed conductor 50 of the present embodiment has a flat square shape, the center corresponds to the intersection of the two diagonal lines of the opposed conductor 50. The number of conductors constituting the short-circuit part 70 is not particularly limited. The short-circuit part 70 may be provided as a plurality of conductors connecting the substantial center (i.e., a central region) of the opposed conductor 50 and the ground plate 40.

The intermediate conductor 80 is a conductor having the same potential (i.e., ground potential) as the ground plate 40, which is arranged between the ground plate 40 and the opposed conductor 50 in the Z direction. The intermediate conductor 80 of the present embodiment is an inner layer ground arranged inside the base material of the circuit board 11. The intermediate conductor 80 is electrically connected to the ground plate 40 on the circuit board 11. The connecting part between the intermediate conductor 80 and the ground plate 40 is provided in at least one of the regions R1 and R2. The intermediate conductor 80 is also formed by patterning a metal foil arranged on the base material 30 (i.e., the thin plate 30A).

The intermediate conductor 80 has a penetration part 81 that penetrates the intermediate conductor 80 in the Z direction. The penetration part 81 is provided so as to overlap the opposed conductor 50 in a plan view (see dashed lines in FIG. 3). The penetration part 81 may have two parts, i.e., a part directly below the opposed conductor 50 and a peripheral part surrounding the part directly below the opposed conductor 50. In a plan view, the intermediate conductor 80 has a predetermined gap between the intermediate conductor 80 and the opposed conductor 50 (see L1, L2, and L3 in FIG. 3). The intermediate conductor 80 is arranged around or at the proximity of the opposed conductor 50 so as not to overlap the opposed conductor 50 in a plan view. FIGS. 2 and 3 show intermediate conductor 80 around three sides of the opposed conductor 50, separated by distances of L1, L2, and L3.

The penetration part 81 is provided as a notch (shown in FIG. 2) or a through hole (not shown). The penetration part 81 of the present embodiment is a notch. The penetration part 81 has a substantially rectangular shape in a plane. Specifically, the penetration part 81 has a rectangular shape with the X direction as the longitudinal direction and the Y direction as the lateral direction. Three sides of the rectangular penetration part 81 are defined by the intermediate conductor 80 (specifically, defined by three internal vertical surfaces of each intermediated conductor 80), and the remaining one side is defined by the board end part (side surface) 11*a*. The intermediate conductor 80 has a substantially C-shaped plane (or a substantially U-shaped plane).

The number of intermediate conductors 80 arranged between the ground plate 40 and the opposed conductor 50 is not particularly limited. At least one conductor 80 may be placed therein. The intermediate conductor 80 may be arranged in multiple stages/layers in the Z direction. The intermediate conductor 80 of the present embodiment is arranged in two stages (i.e., in two layers). The configurations of the two intermediate conductors 80 are common to each other. The intermediate conductors 80 may substantially coincide/match with each other in a plan view.

Operation of the Antenna Device

Next, the operation of the antenna device 20 is described. As described above, the antenna device 20 has a structure in which the ground plate 40 and the opposed conductor 50 facing each other are connected by the short-circuit part 70. Such a structure is a so-called mushroom structure, which is the same as the basic structure of metamaterials. Since the antenna device 20 is an antenna to which the metamaterial technology is applied, it is sometimes called as a metamaterial antenna.

Since the antenna device 20 is designed to operate in a 0th-order resonance mode at a desired operation frequency, it is sometimes referred to as a 0th-order resonance antenna. Among the dispersion characteristics of the metamaterial, the phenomenon of resonance at a frequency at which a phase constant $\beta$ becomes zero (0) is the 0th-order resonance. The phase constant $\beta$ is an imaginary part of a propagation coefficient y of the wave propagating on the transmission line. The antenna device 20 can satisfactorily transmit and/or receive radio waves in a predetermined band including a frequency at which 0th-order resonance occurs.

The antenna device 20 operates by LC parallel resonance of the capacitance formed between the ground plate 40 and the opposed conductor 50 and the inductance provided in the short-circuit part 70. In the antenna device 20, the opposed conductor 50 is short-circuited to the ground plate 40 by the short-circuit part 70 provided in the central region thereof. The area size of the opposed conductor 50 is an area size that forms a capacitance that resonates in parallel with the inductance of the short-circuit part 70 at a desired frequency (i.e., at the operation frequency). Note that the inductance is determined according to the dimensions of each part of the short-circuit part 70, that is, for example, the diameter and the length in the Z direction.

Therefore, when electric power of the operation frequency is supplied, parallel resonance occurs due to energy exchange between the inductance and the capacitance, thereby an electric field perpendicular to the ground plate 40 (and to the opposed conductor 50) is generated between the ground plate 40 and the opposed conductor 50. That is, an electric field in the Z direction is generated. The vertical electric field (perpendicular to the ground plate 40) propagates from the short-circuit part 70 toward the edge of the opposed conductor 50, becomes vertically polarized at the edge of the opposed conductor 50, and propagates in space. Note that the vertically polarized wave here refers to a radio wave in which the vibration direction of the electric field is perpendicular to the ground plate 40 and the opposed conductor 50. Further, the antenna device 20 receives vertically polarized waves arriving from the outside of the antenna device 20 by LC parallel resonance.

The resonance frequency of the 0th-order resonance does not depend on the antenna size. Therefore, the length of one side of the opposed conductor 50 can be made shorter than ½ wavelength of the 0th-order resonance frequency. For example, even if one side has a length equivalent to ¼ wavelength, 0th-order resonance can be generated. It is possible to make it shorter than ¼ wavelength, but in such case the gain is reduced, for example.

Summary of the First Embodiment

Figure 5:
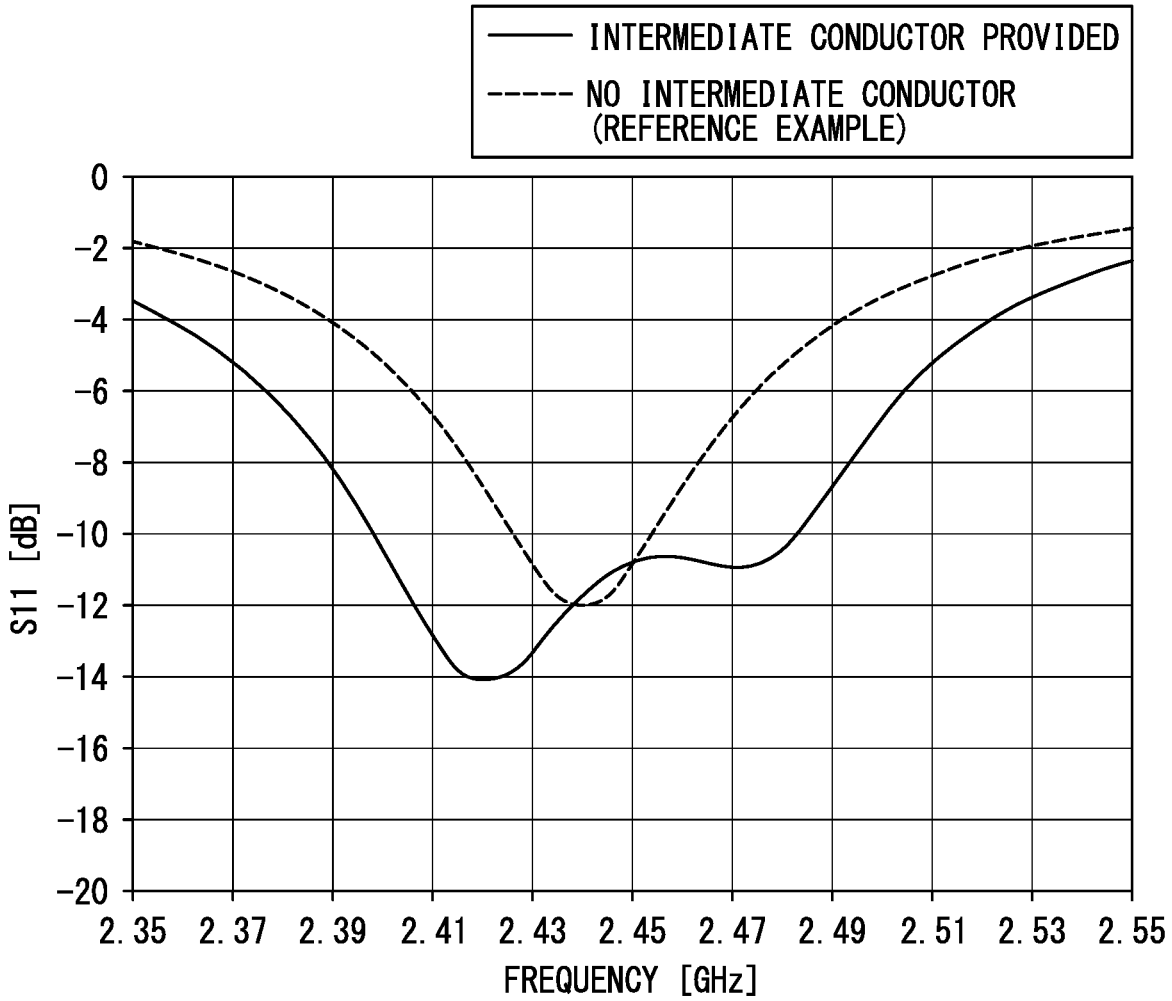
FIG. 5 is a diagram showing reflection characteristics.

FIG. 5 shows the results of performing an electromagnetic field simulation (reflection characteristics) with the same operation frequency in a reference example and the present embodiment. The operation frequency is 2.44 GHz. In FIG. 5, the broken line shows the result of the reference example, and the solid line shows the result of the present embodiment, that is, the antenna device 20 having the above-described configuration. The antenna device of the reference example is a 0th-order resonance antenna having no intermediate conductor. In the reference example and the present embodiment, the composition (i.e., the dielectric constant and the thickness) of the base material and the diameter of the short-circuit part are the same as each other. Then, the optimization design was performed according to the size (i.e., area size) of the opposed conductor. More specifically, the opposed conductor of the reference example has a square shape with one side of 15.64 mm, and the opposed conductor of the present embodiment has a square shape with one side of 14.9 mm.

In a 0th-order resonance antenna that does not have an intermediate conductor as in the reference example, the operation becomes unstable if the area size of the ground plate is small. In the 0th-order resonance antenna, for example, in order to improve the reflection characteristics, it is ideal that the ground plate has an infinite size. Therefore, it is preferable to set the length of each side of the plane, rectangular ground plate to a length of one wavelength or more. In the reference example, the length of each side is longer than one wavelength. Even if the size of the ground plate is taken into consideration, the frequency bandwidth, which is the bandwidth of the return loss S11=−10 dB, is narrow in the antenna device that is not provided with the intermediate conductor, as shown by the broken line in FIG. 5. Note that, when the length of each side of the ground plate is made shorter than one wavelength, the reflection characteristics deteriorate as compared with the broken line shown in FIG. 5, and the frequency bandwidth is further narrowed.

Figure 6:
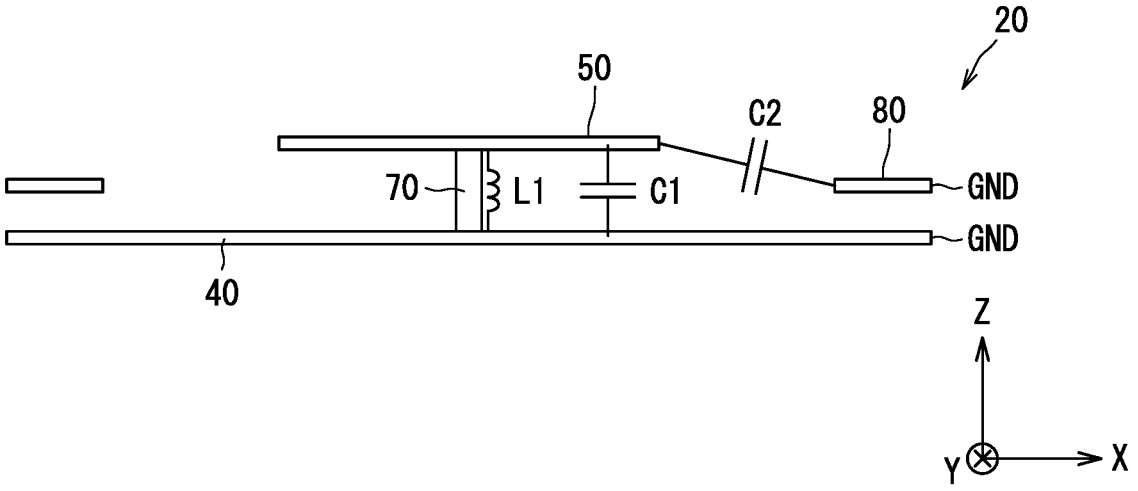
FIG. 6 is a diagram showing an inductor and a capacitor of the antenna device.

On the other hand, according to the present embodiment, as shown by the solid line in FIG. 5, the reflection characteristics is improvable as compared with the reference example. The provision of the intermediate conductor 80 increases the frequency bandwidth. According to the antenna device 20 of the present embodiment, as shown in FIG. 6, a capacitor C2 is additionally formed in the parallel resonance structure of an inductor L1 by the short-circuit part 70 and a capacitor C1 between the ground plate 40 and the opposed conductor 50. The capacitor C2 is formed between the intermediate conductor 80, which has a ground potential together with the ground plate 40, and the opposed conductor 50. That is, a parallel resonance structure of the inductor L1 and the capacitor C2 is added. Since a resonance point is formed by the capacitor C2, the frequency bandwidth becomes wide as shown in FIG. 5.

As described above, according to the present embodiment, it is possible to provide the antenna device 20 having a wide band (i.e., frequency bandwidth). Since the band is wide, it is not easily affected by reflection by the metal of the housing and switching noise of the power supply circuit formed on the circuit board 11, for example.

The size of the penetration part 81, that is, the length in the direction parallel to each side of the opposed conductor 50 is not particularly limited. The penetration part 81 may be provided so as to include the opposed conductor 50 at least in a plan view. The capacitor C2 is formed by having a gap between the intermediate conductor 80 and the opposed conductor 50 in a plan view. Since the intermediate conductor 80 has the penetration part 81 including the opposed conductor 50, the antenna device 20 can have a wide band.

In the above configuration, a part of the ground plate 40 that overlaps the penetration part 81 in a plan view substantially functions as the ground plate (i.e., as a ground). Therefore, the ground plate 40 can be made smaller according to the size of the penetration part 81. By making the ground plate 40 smaller, the physique/dimension of the antenna device 20 can be made smaller. Therefore, it is preferable to set the size of the penetration part 81 within a range in which the physique/dimension of the antenna device 20 can be reduced, in other words, in a range in which the length of each side of the ground plate 40 can be made shorter than one wavelength of the operation frequency. Further, the size of the penetration part 81 may be set so that the frequency bandwidth becomes wider at the 0th-order resonance frequency (i.e., the operation frequency).

In performing the electromagnetic field simulation described above, as shown in FIG. 3, the length of the penetration part 81 in the X direction is defined as LX, and the length of the penetration part 81 in the Y direction is defined as LY. Further, a distance between the opposed conductor 50 and the intermediate conductor 80 in a plan view is defined as L1 and L2 in the X direction, and a distance between the opposed conductor 50 and the intermediate conductor 80 in a plan view is defined as L3 in the Y direction. Also a distance between an end face of the board (i.e., one end of the penetration part 81) and the opposed conductor 50 is defined as L4 in the Y direction. Then, the distances L1 and L2 are set to 6 mm, the distance L3 is set to 2.5 mm, and the distance L4 is set to 3.2 mm.

The length of each side of the (substantially square) opposed conductor 50 in the present embodiment is 14.9 mm, which corresponds to about ¼ wavelength of the operation frequency (i.e., the 0th-order resonance frequency). Therefore, the length LX of the penetration part 81 in the X direction is 26.9 mm, and the length LY thereof in the Y direction is 20.6 mm. The size of the penetration part 81 is shorter than ½ wavelength of the operation frequency in both of the X direction and the Y direction. Even if the size of the penetration part 81 is made shorter than ½ wavelength of the operation frequency in such manner, the band can be widened as shown by the solid line in FIG. 5. Note that a wavelength $\lambda\varepsilon$ of the radio wave of the operation frequency (i.e., the 0th-order resonance frequency) can be obtained by (300 [mm/s]/2.44 [GHz])/square root of the permittivity of the base material 30. In the present embodiment, the dielectric constant of the base material 30 is 4.4. In the configuration including the base material 30, all the wavelengths shown in the embodiment are the above-mentioned wavelength $\lambda\varepsilon$.

First Modification

Figure 7:
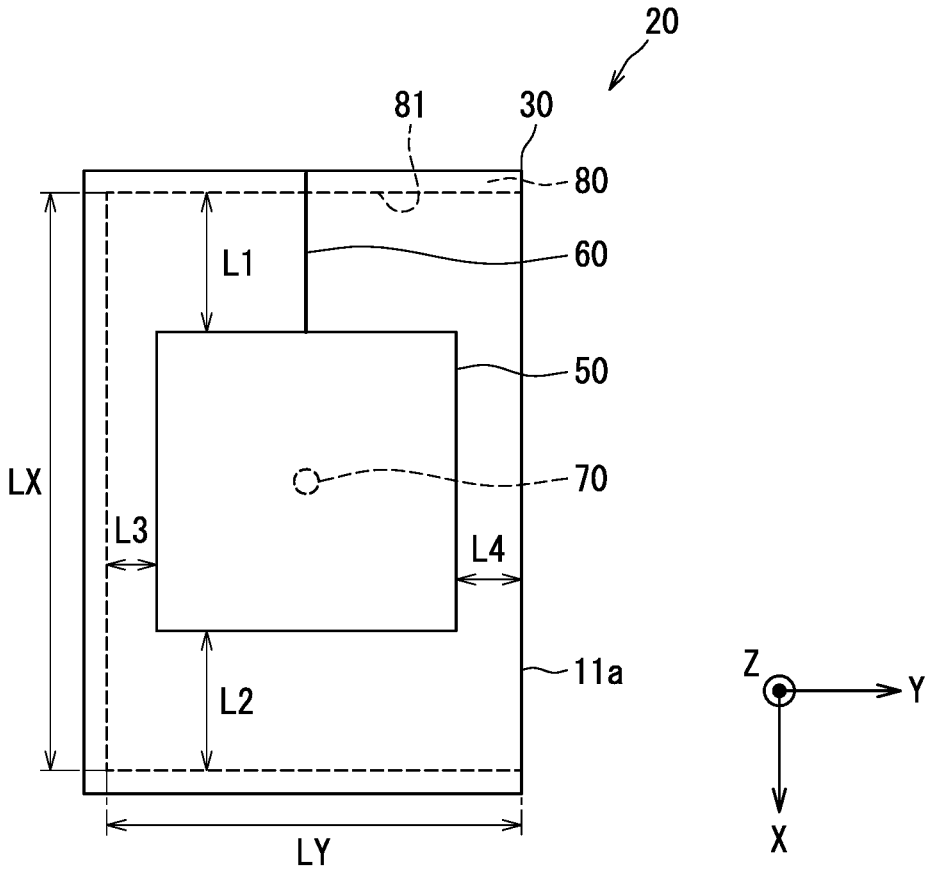
FIG. 7 is a plan view showing a modification example.

FIG. 7 shows a first modification example of the antenna device 20. FIG. 7 corresponds to FIG. 3. In the antenna device 20 of FIG. 7, the distances L1 to L4, and the lengths LX, and LY set in the electromagnetic field simulation are applied. Since the intermediate conductor 80 only needs to have a size and a shape capable of defining the penetration part 81, a frame body narrower than that in FIG. 3 is adopted in FIG. 7. The width of the intermediate conductor 80 is, for example, shorter than ¼ wavelength. The width is, for example, shorter than any of the distances L1 to L4. The ground plate 40 may be arranged at least in a part/position that overlaps with the penetration part 81. When the ground plate 40 matches the penetration part 81, the length of the ground plate 40 in the X direction is 26.9 mm, and the length thereof in the Y direction is 20.6 mm. The ground plate 40 may be aligned with (in parallel with) the penetration part 81 and the frame body.

In such manner, the size of the ground plate 40 can be made less than ½ wavelength or about the same as ½ wavelength in both of the X direction and the Y direction. Even if the size of the ground plate 40 is made smaller to about the size of ½ wavelength or less, it is possible to suppress the narrowing of the frequency bandwidth. Even in the configuration shown in FIG. 7, the same effects as those of the present embodiment shown by the solid line in FIG. 5 are obtainable. Therefore, the physique/dimension can be made smaller while widening the frequency bandwidth.

The relationship between the distances L3 and L4 is not limited to the above example. In the present embodiment, the antenna device 20 is provided in the region including the board end part 11*a* (i.e., the side surface). That is, the opposed conductor 50 is arranged in the vicinity of the board end part 11*a*. Due to such an arrangement, the length of the ground plate 40 located on a board end part 11*a* side of the opposed conductor 50 and the length of the ground plate 40 located on an opposite side of the board end part 11*a* along the Y direction are different. In other words, the arrangement of the ground plate 40 is uneven and biased in the Y direction with respect to the center of the opposed conductor 50. Since the ground plate 40 on the board end part 11*a* side is short, the intermediate conductor 80 is not arranged on the board end part 11*a* side with respect to the opposed conductor 50, and the penetration part 81 is cut out as a notch.

Figure 8:
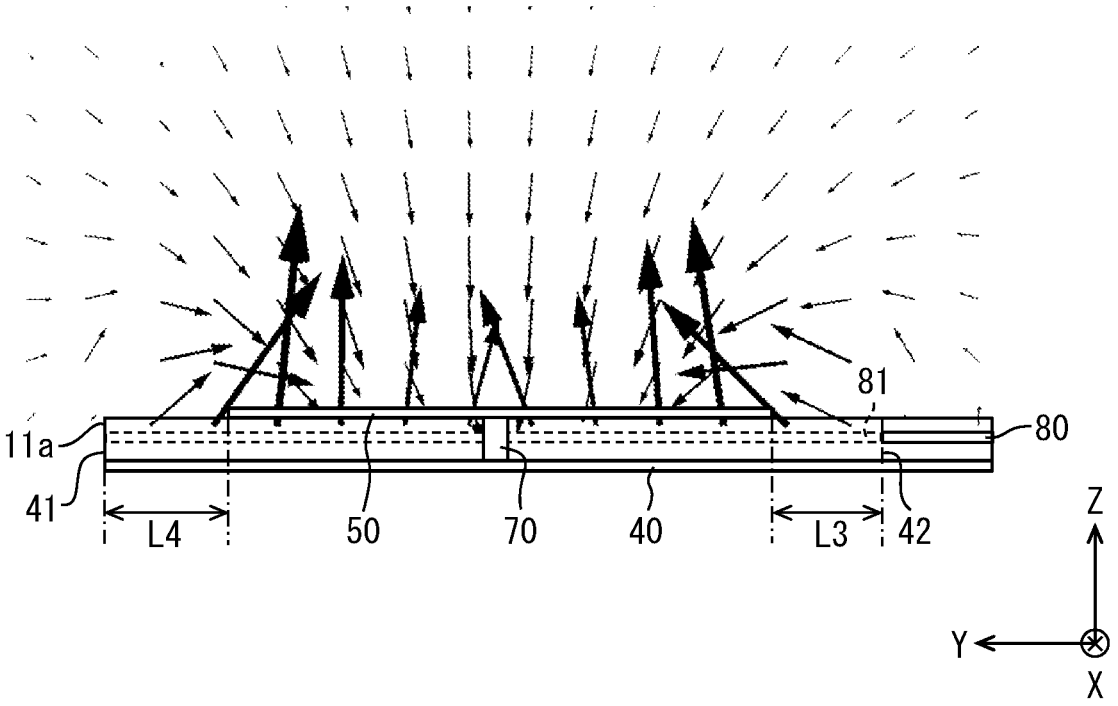
FIG. 8 is a diagram showing an electric field distribution.

In such a configuration, as shown in FIG. 8, a discontinuous face 41 is formed at an interface between the board end part 11*a* (i.e., the circuit board 11) and the outside (i.e., air) in the Y direction. Further, a discontinuous face 42 formed by the penetration part 81 of the intermediate conductor 80 is formed on a side opposite to the discontinuous face 41. Since the difference in dielectric constant is large, the discontinuous face 41 is more likely to reflect the electric field than the discontinuous face 42. When the distance L4 on the board end part 11*a* side is made longer than the distance L3 on the opposite side as shown in the present embodiment, the bias of the electric field with respect to the X axis can be suppressed, or the electric field may be made substantially symmetrical thereto. By adjusting the distance from the opposed conductor 50 toward the end part of the penetration part 81 in such manner, it is possible to suppress deterioration of the reflection characteristics otherwise caused by the asymmetrical arrangement of the ground plate 40 with respect to the opposed conductor 50.

The relationship between the lengths L1 and L2 is not limited to the above example. In the X direction, discontinuous faces formed by the penetration parts 81 of the intermediate conductor 80 are formed on both sides of the opposed conductor 50. Since the reflections on the discontinuous faces are substantially equal, the electric fields can be made substantially symmetrical with respect to the Y axis by making the distances L1 and L2 substantially equal to each other as described above.

The thickness of the base material 30 and the number of layers are not limited to the above examples. The capacitance of the capacitors C1 and C2 and the inductance of the inductor L1 can be adjusted by adjusting the thickness of the base material 30 (i.e., the thin plate 30A).

Second Embodiment

The second embodiment is a modification of a precedent embodiment which serves as a basic configuration, and may incorporate description of the precedent embodiment. In the preceding embodiment, a notch is adopted as the penetration part 81. Instead, a through hole may also be adoptable.

Figure 9:
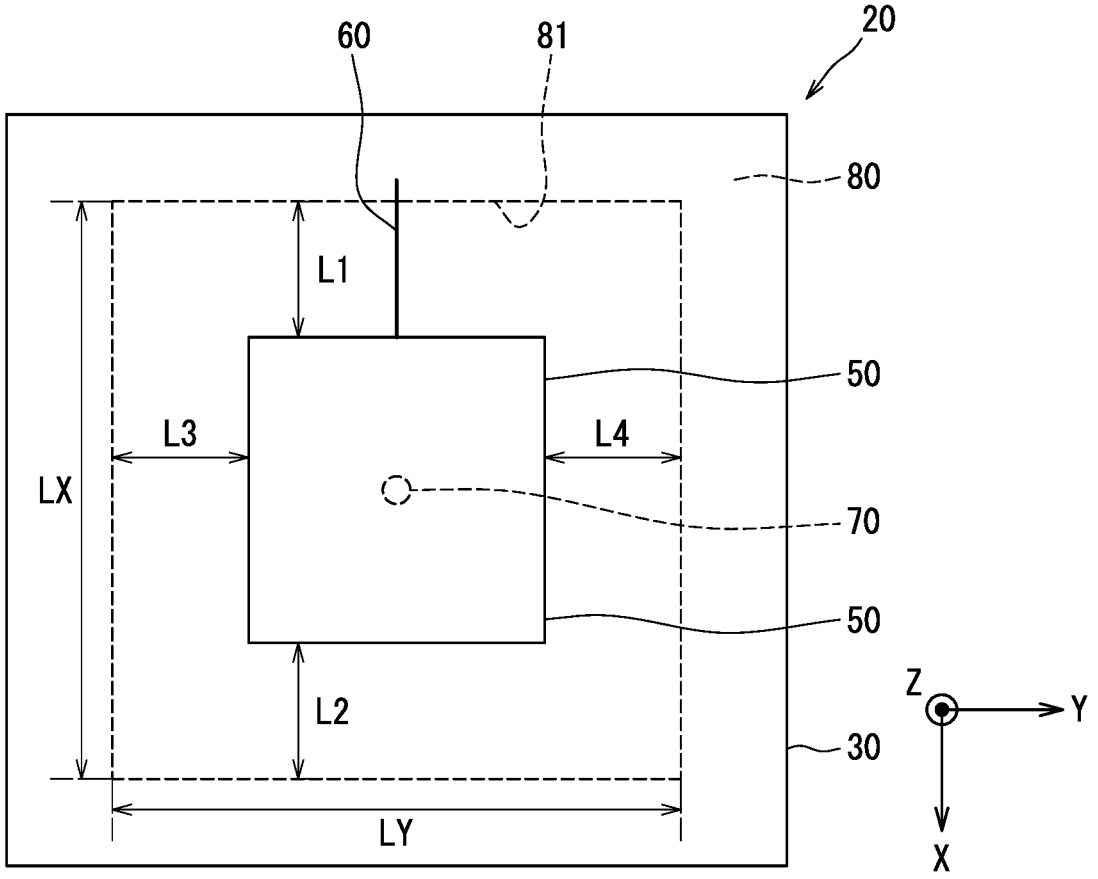
FIG. 9 is a plan view showing the antenna device according to a second embodiment.

FIG. 9 shows the antenna device 20 of the present embodiment. FIG. 9 corresponds to FIG. 3. The antenna device 20 is formed away from the board end part 11*a* (i.e., the side surface). The intermediate conductor 80 has a through hole (a rectangular hole) as the penetration part 81. The penetration part 81 (overlaps) at least the opposed conductor 50. The intermediate conductor 80 has an enclosed rectangular cutout near its center. The intermediate conductor 80 surrounds the opposed conductor 50 in a plan view.

In the present embodiment, the penetration part 81 is formed as a substantially square plane. The lengths LX and LY of the penetration part 81 are substantially equal to each other. As for the distance between the opposed conductor 50 and the intermediate conductor 80 in a plan view, the distances L1 and L2 in the X direction are substantially equal to each other. The distances L3 and L4 in the Y direction are also substantially equal to each other. The distances L1 to L4 are substantially equal to each other, in other words. Other configurations are the same as those described in the preceding embodiments. FIG. 9 illustrates bilateral symmetry with respect to a central axis in the X direction, and also exhibits bilateral symmetry with respect to a central axis in the Y direction (except for the feeder line 60).

Summary of the Second Embodiment

The antenna device 20 of the present embodiment also has the same effects as the configuration described in the preceding embodiment. For example, even in a configuration in which a through hole is adopted as the penetration part 81, the capacitor C2 is formed between the opposed conductor 50 and the intermediate conductor 80 (see FIG. 6). Therefore, it is possible to provide the antenna device 20 having a wide band (i.e., wide frequency bandwidth).

The size of the penetration part 81 is not particularly limited. Since a part of the ground plate 40 that overlaps the penetration part 81 in a plan view substantially functions as the ground plate (i.e., as a ground), the size of the penetration part 81 may be set within a range in which the physique/dimension of the antenna device 20 can be reduced. Further, the size of the penetration part 81 may be set so that the frequency bandwidth becomes wider at the 0th-order resonance frequency (i.e., the operation frequency).

Also in the present embodiment, the band can be widened when the size of the penetration part 81, that is, the lengths LX and LY of the penetration part 81 are shorter than ½ wavelength of the operation frequency. Even if the size of the ground plate 40 is reduced to about ½ wavelength or less, it is possible to suppress the narrowing of the frequency bandwidth. Therefore, the physique/dimension can be made smaller while widening the frequency bandwidth.

The relationship between the distances L1 and L2 and the relationship between the distances L3 and L4 are not limited to the above examples. Discontinuous faces formed by the penetration parts 81 of the intermediate conductor 80 are positioned/provided on both sides of the opposed conductor 50 in the X direction. Since the reflections on the discontinuous faces are substantially equal, the electric fields can be made substantially symmetrical with respect to the Y axis by making the distances L1 and L2 substantially equal to each other as described above. Similarly, by making the distances L3 and L4 substantially equal to each other, the electric field can be made substantially symmetrical with respect to the X axis.

The distance L1 (L2) and the distance L3 (L4) may be made different from each other. In the present embodiment, since the distances L1 to L4 are substantially equal to each other, the conductors 50 have directivity in all directions from the central region toward the edge.

Third Embodiment

The third embodiment is a modification of a precedent embodiment which serves as a basic configuration, and may incorporate description of the precedent embodiment. In the preceding embodiment, the opposed conductor 50 has a flat square shape. Instead, a slit may be provided in the opposed conductor 50 that otherwise has a flat square shape.

Figure 10:
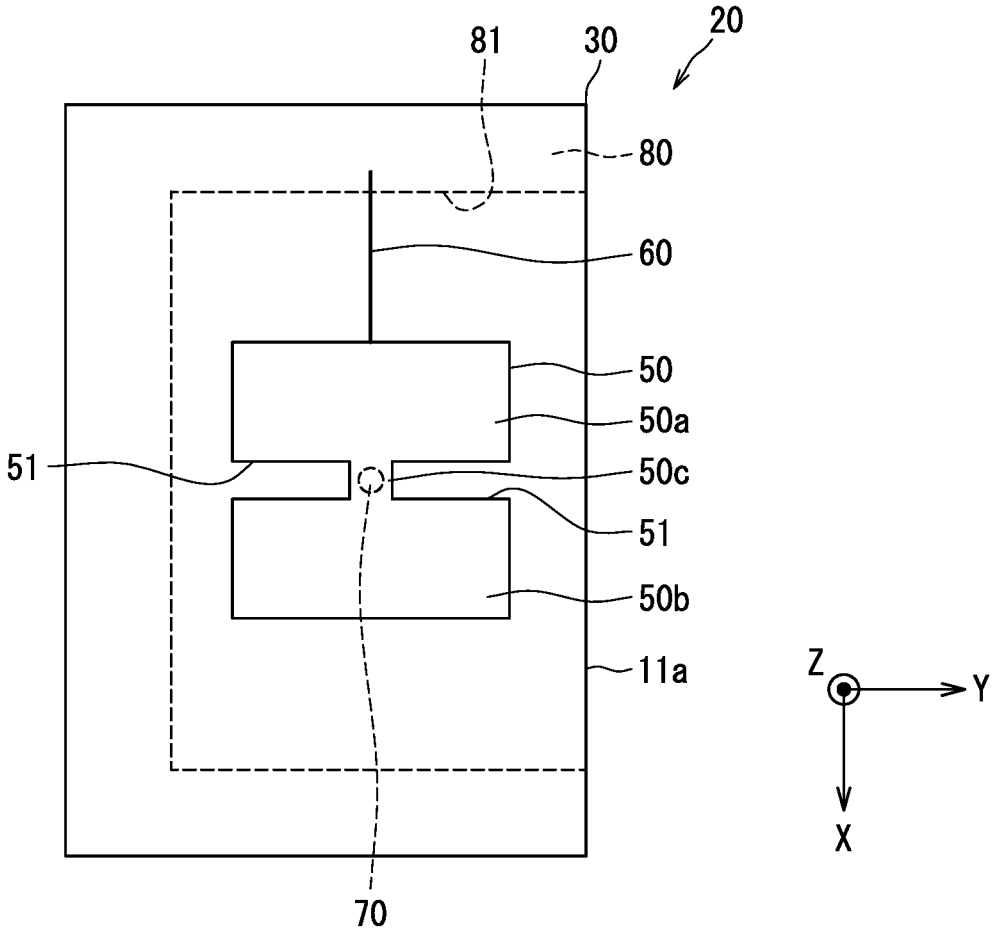
FIG. 10 is a plan view showing the antenna device according to a third embodiment.

FIG. 10 shows the antenna device 20 of the present embodiment. FIG. 10 corresponds to FIG. 3. The antenna device 20 is formed in a region including the board end part 11*a*, as in the configuration described in the first embodiment. At least one slit 51 is formed in the opposed conductor 50. The slit 51 has a predetermined depth in the Z direction and is open to one of the end faces (side surfaces) of the opposed conductor 50.

The slit 51 of the present embodiment penetrates the opposed conductor 50 in the Z direction. The opposed conductor 50 has two slits 51 (a left slit 51 open in a left side, and a right slit 51 open in a right side in FIG. 10). The two slits 51 are provided so that the opposed conductor 50 has two-fold symmetry about the Z axis. The two slits 51 are provided so as to sandwich the short-circuit part 70, in other words, to bind the center of the opposed conductor 50 in the Y direction in a plan view. One of the slits 51 opens its mouth on the side surface of the opposed conductor 50 on the board end part 11*a* side, and the other one of the slits 51 opens on the side surface on the opposite side. The slit 51 opens on two side surfaces facing each other to which the feeder line 60 is not connected.

The extension length and width of the two slits 51 are equal to each other. The slit 51 divides the opposed conductor 50 into a first opposed part 50*a* and a second opposed part 50*b*. The first opposed part 50*a* and the second opposed part 50*b* have the same shape and area size. A part sandwiched by the two slits 51 forms a connecting part 50*c* that connects the first opposed part 50*a* and the second opposed part 50*b*. The opposed conductor 50 has the first opposed part 50*a*, the second opposed part 50*b*, and the connecting part 50*c*, in other words. The extension length of the slit 51 is longer than the length of the connecting part 50*c* in the Y direction, and the width of the slit 51 is shorter than that of the first opposed part 50*a* and the second opposed part 50*b*. The opposed conductor 50 forms a flat, substantially square shape in which the slit 51 is cut and removed from the square shape.

Figure 11:
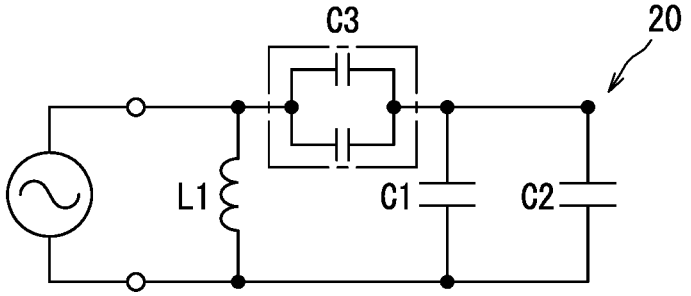
FIG. 11 is an equivalent circuit diagram of the antenna device.

FIG. 11 is an equivalent circuit diagram of the antenna device 20. In FIG. 11, for convenience, some circuit elements, for example, the inductor included in the opposed conductor 50, are omitted. By providing the slit 51, a capacitor C3 is formed between the first opposed part 50*a* and the second opposed part 50*b*. The capacitor C3 is a parallel circuit (an equivalence capacitor) of capacitors formed in each of the two slits 51. The capacitor C3 is connected in series with another parallel circuit formed of capacitors C1 and C2.

Summary of Third Embodiment

Figure 12:
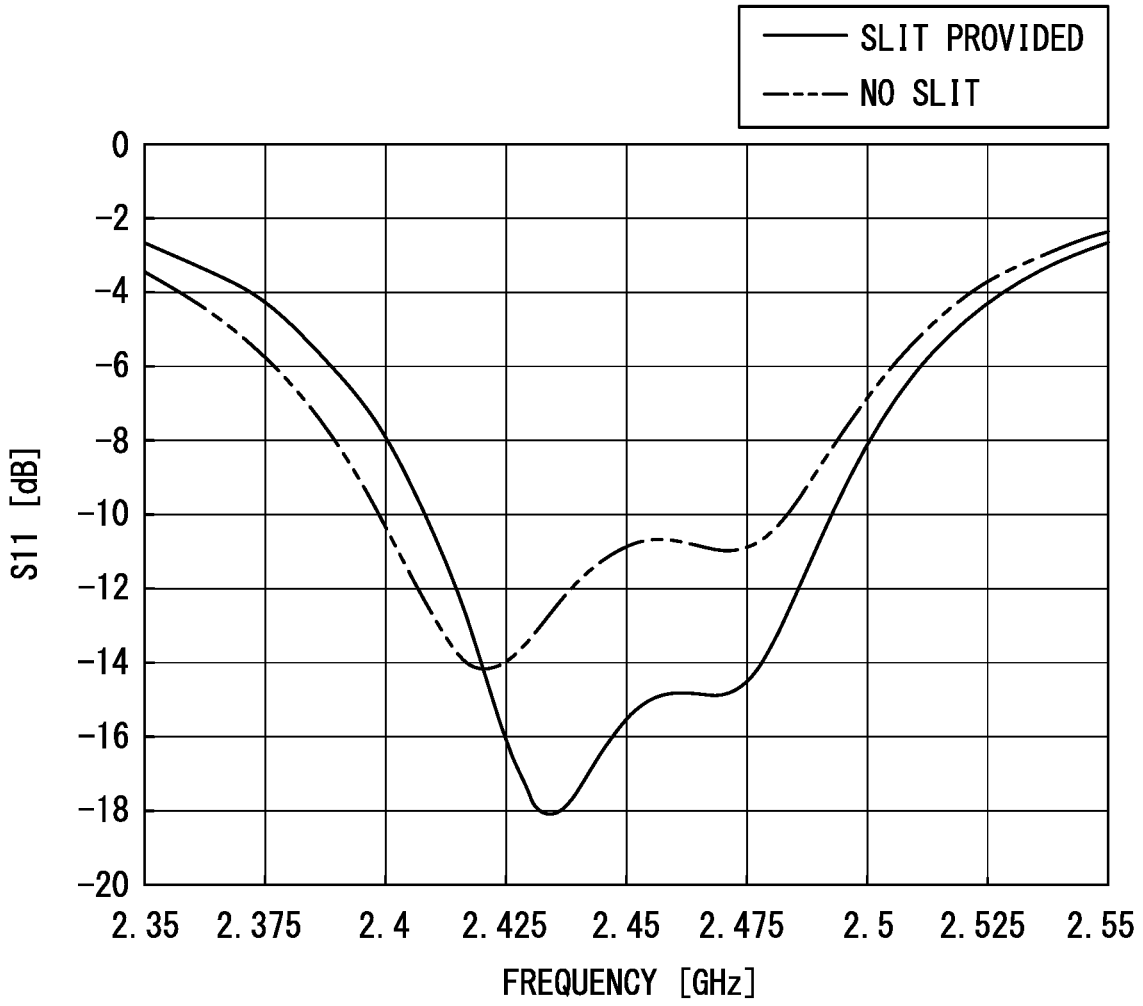
FIG. 12 is a diagram showing reflection characteristics.

FIG. 12 shows the results of the electromagnetic field simulation (reflection characteristics). The basic conditions of the electromagnetic field simulation are the same as those of the preceding embodiments. More specifically, the operation frequency, the composition of the base material (dielectric constant and thickness), and the diameter of the short-circuit part are the same as those in the preceding embodiments. Further, the size of the penetration part 81, that is, the lengths LX and LY are also the same as in the preceding embodiments. Then, the optimization design is performed based on the size of the opposed conductor 50 and the size of the slit 51. The size of the opposed conductor 50 means the size of the area facing the ground plate 40 and the opposed conductor 50. The size of the slit 51 means the length and width of the slit. As discussed above, slit 51 in the third embodiment may be a pair of slits (left slit 51 and right slit 51).

More specifically, each side of the opposed conductor 50 is set to 13 mm. Further, the length of the left slit 51 in the extending direction is set to 5.6 mm, and the width thereof is set to 1.75 mm. For comparison, FIG. 12 shows an example of the preceding embodiment (i.e., without slits) shown in FIG. 5 by the solid line. The "without a slit" example is shown in FIG. 12 by a two-dot chain line, and the example of the present embodiment (with a left slit and a right slit) is shown by a solid line.

The antenna device 20 of the present embodiment also includes an intermediate conductor 80, which forms a capacitor C2. As a result, the frequency bandwidth can be widened as shown in FIG. 12.

In the present embodiment, by providing the slit 51 in the opposed conductor 50, the area size of the opposed conductor 50 is reduced, thereby reducing the capacitance of the capacitor C1. On the other hand, the slit 51 connects the capacitor C3 in series with the capacitor C1. In such manner, the number of variables that determine the overall capacitance increases. The capacitance of the capacitor C3 can be set, for example, by the extended length and/or width of the slit 51.

By providing the capacitor C3 in such manner, the degree of freedom in designing the antenna device 20 (i.e., a 0th-order resonance antenna) is improved. Therefore, as shown in FIG. 12, the reflection characteristics can be improved as compared with the case without slits. It is also possible to adjust (i.e., shift) the frequency band.

Further, the opposed conductor 50 can have a smaller body size while having characteristics equal to or higher than those of the configuration having no slit 51. By downsizing, for example, in the circuit board 11, the degree of freedom in arranging the opposed conductor 50 can be improved. More specifically, it can fit in a narrower/smaller space.

The shape, size, arrangement, and the number of slits 51 are not limited to the above examples. For example, the positions of the two slits 51 may be staggered in the X direction (i.e., not on one virtual straight line). Further, the slit 51 may be provided so as to open on the side surface in the X direction. Only one slit 51 may be provided, or three or more slits 51 may be provided. The slit 51 is not limited to a straight line shape. For example, a slit 51 having a substantially L-shaped, flat form may be adopted. As described above, if the slit 51 is provided so that the opposed conductor 50 has two-fold symmetry, the bias of the electric field distribution can be suppressed.

Though an example in which the slit 51 penetrates the opposed conductor 50 in the Z direction is shown, the present invention is not limited to such example. The slit 51 in the opposed conductor 50 may have a half depth of the conductor 50, i.e., may have a groove shape. Even in such a structure, the capacitor C3 is formed between the facing surfaces of the first opposed part 50*a* and the second opposed part 50*b*.

Though an example of combining the slit 51 with the configuration described in the first embodiment has been shown, the present invention is not limited to such an example. The configuration of the present embodiment can also be combined with the configuration described in the second embodiment.

Fourth Embodiment

The fourth embodiment is a modification of a precedent embodiment which serves as a basic configuration, and may incorporate description of the precedent embodiment. In addition to the configuration described in the preceding embodiments, a shield wall may further be provided.

Figure 13:
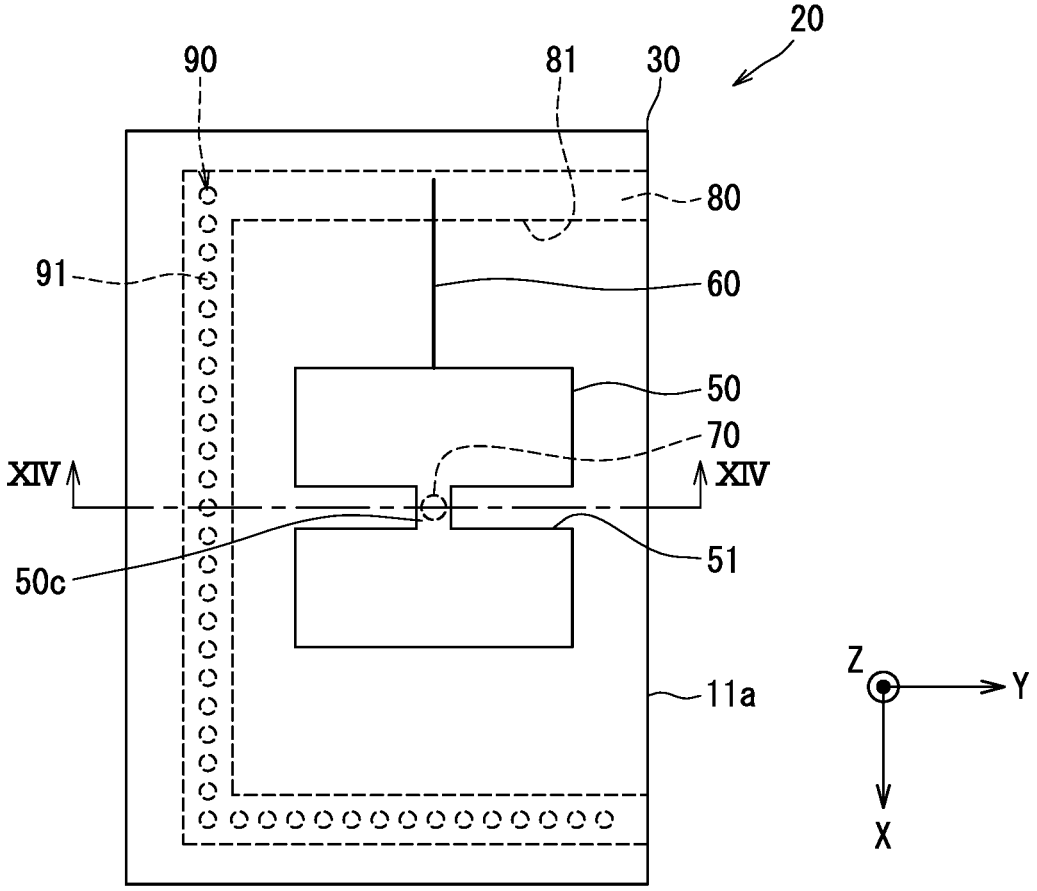
FIG. 13 is a plan view showing an antenna device according to a fourth embodiment.
Figure 14:
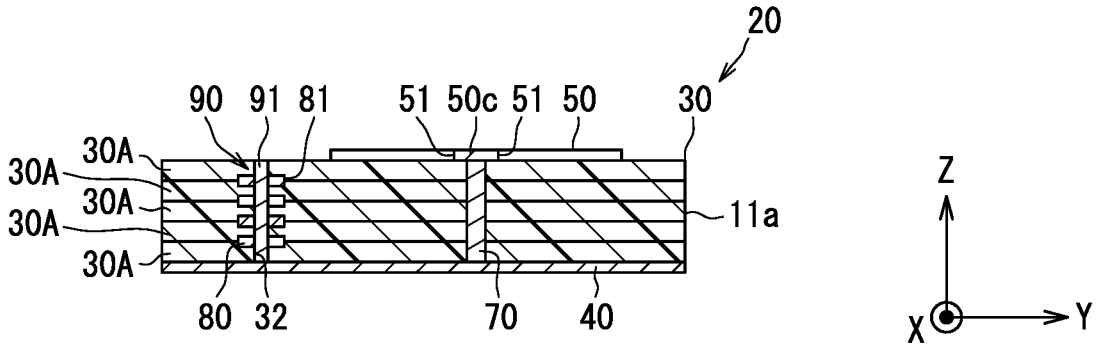
FIG. 14 is a cross-sectional view taken along a line XIV-XIV of FIG. 13.

FIGS. 13 and 14 show the antenna device 20 of the present embodiment. FIG. 13 corresponds to FIG. 10. FIG. 14 is a cross-sectional view taken along a line XIV-XIV of FIG. 13. The antenna device 20 further includes a shield wall 90. The configuration other than the shield wall 90 is a combination of the configuration described in the third embodiment (see FIG. 10) and the intermediate conductor 80 described in the modification example (see FIG. 7).

The shield wall 90 is composed of a plurality of columnar parts 91. The columnar part 91 is connected to the intermediate conductor 80, and extends in the Z direction. The columnar part 91 is a columnar conductor connected to the intermediate conductor 80 and set as a ground potential. The plurality of columnar parts 91 function as a wall for blocking/interrupting radio waves by being arranged at intervals of ½ wavelength or less of the operation frequency so that radio waves do not leak from between the columnar parts 91. The plurality of columnar parts 91 are arranged along an inner edge of the intermediate conductor 80 that defines the penetration part 81. In the configuration in which the intermediate conductors 80 are arranged in multiple layers (multi-stage), the columnar part 91 is connected to at least one intermediate conductor 80.

The columnar part 91 has a conductor arranged in a through hole 32 penetrating the thin plate 30A of at least one layer. The columnar part 91 is provided as, for example, a via conductor or a through-hole conductor. The through hole 32 may be formed in units of the thin plate 30A (i.e., may be formed plate 30A to plate 30A). The through hole 32 may also be formed on the base material 30 which is made as a layered thin plates 30A. In the present embodiment, the through hole 32 penetrates the base material 30, and each of the columnar parts 91 extends from the ground plate 40 to the upper surface of the base material 30. The columnar part 91 is connected to the ground plate 40.

As shown in FIG. 13, three sides of the rectangular penetration part 81 are defined by the intermediate conductor 80, and the remaining one side is defined by the board end part 11*a*. The intermediate conductor 80 is a narrow frame having a flat, substantially C shape (i.e., substantially U shape). The plurality of columnar parts 91 are arranged along the frame of the intermediate conductor 80. The columnar parts 91 are arranged on two sides of the intermediate conductor 80, other than a side toward which the feeder line 60 extends. The shield wall 90 has a substantially L shape in a plan view. The shield wall 90 is provided on a side opposite to the feeder line 60 in the X direction with respect to the opposed conductor 50. Further, the shield wall 90 is provided on a side opposite to the board end part 11*a* in the Y direction.

Note that, in the present embodiment, the base material 30 is formed by laminating five thin plates 30A, and the intermediate conductor 80 is arranged in four layers. The intermediate conductors 80 of each layer have the same configuration as each other.

Summary of Fourth Embodiment

According to the present embodiment, the shield wall 90 can block/interrupt the energy transmitted from the antenna device 20 to the region R2 of the circuit board 11. Further, the shield wall 90 can block/interrupt the energy entering the antenna device 20 from the circuit formed in the region R2 on the circuit board 11. Since the shield wall 90 is provided outside the penetration part 81, even when having the shield wall 90, the antenna device 20 can achieve the same effects as the configuration described in the preceding embodiments. For example, the frequency bandwidth can be widened.

The arrangement of the shield wall 90 is not limited to the above example. For example, it may be arranged only between the two intermediate conductors 80. In the present embodiment, the shield wall 90 extends from the ground plate 40 to the upper surface of the base material 30. In other words, the shield wall 90 is connected to the ground plate 40 and all the intermediate conductors 80 arranged thereabove. Therefore, the energy transmitted through the circuit board 11 can be effectively interrupted.

An example is shown in the above in which the shield wall 90 is provided on two sides of the intermediate conductor 80 other than the side toward which the feeder line 60 extends. However, the present invention is not limited thereto. The shield wall 90 may be provided on only one side thereof.

An example is shown in the above in which the ground plate 40 extends to the outside of the intermediate conductor 80. However, the present invention is not limited thereto. The configuration may be the same as that of the modification example (see FIG. 7). The number of laminated thin plates 30A and the number of the intermediate conductors 80 constituting the base material 30 are not limited to the above examples.

The shield wall 90 can be combined with each configuration described in the preceding embodiments. An example is shown in the above in which the shield wall 90 is provided in the antenna device 20 in which the opposed conductor 50 has a slit 51. However, the present invention is not limited thereto. The shield wall 90 may be provided in the antenna device 20 in which the opposed conductor 50 having no slit 51 is provided.

Figure 15:
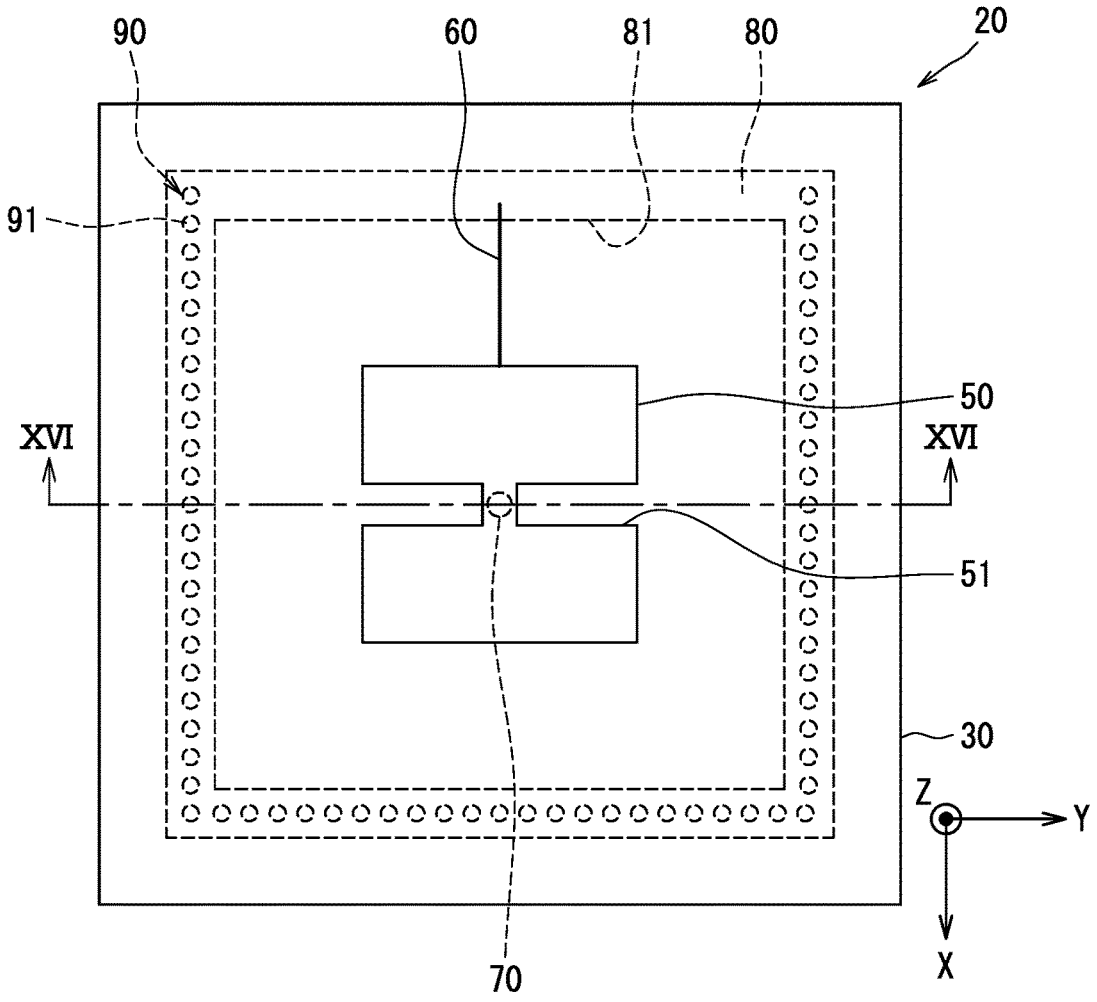
FIG. 15 is a plan view showing a modification example.
Figure 16:
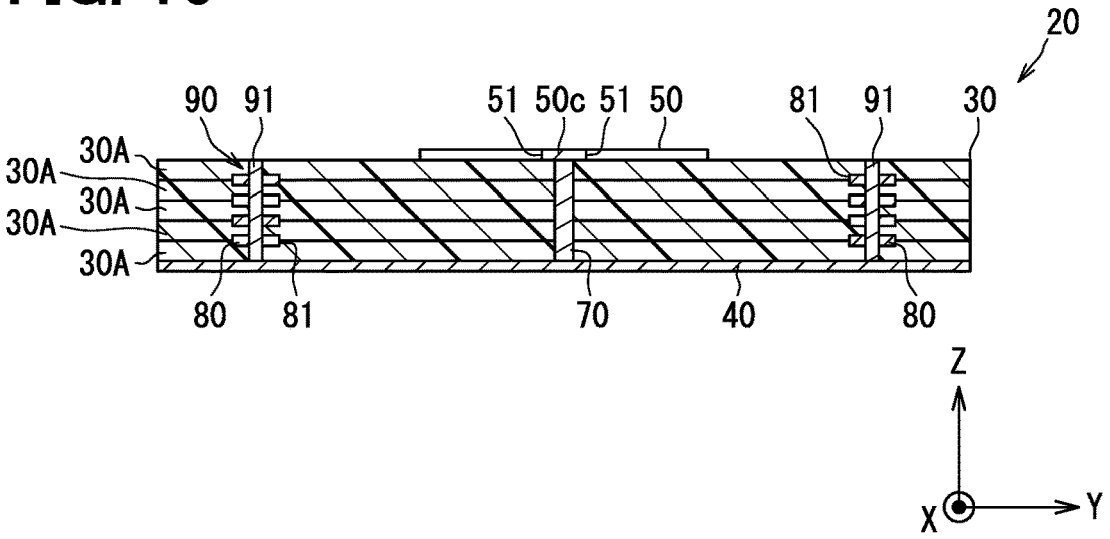
FIG. 16 is a cross-sectional view taken along a line XVI-XVI of FIG. 15.

As in the modification examples shown in FIGS. 15 and 16, the shield wall 90 may be provided on the antenna device 20 that is positioned away from the board end part 11*a*. FIG. 15 corresponds to FIG. 9. FIG. 16 is a cross-sectional view taken along a line XVI-XVI of FIG. 15. The intermediate conductor 80 is a frame body forming a rectangular annular shape. The plurality of columnar parts 91 are arranged on three sides of the intermediate conductor 80, other than a side toward which the feeder line 60 extends. The shield wall 90 has a substantially C shape (i.e., has a substantially U shape) in a plan view.

Figure 17:
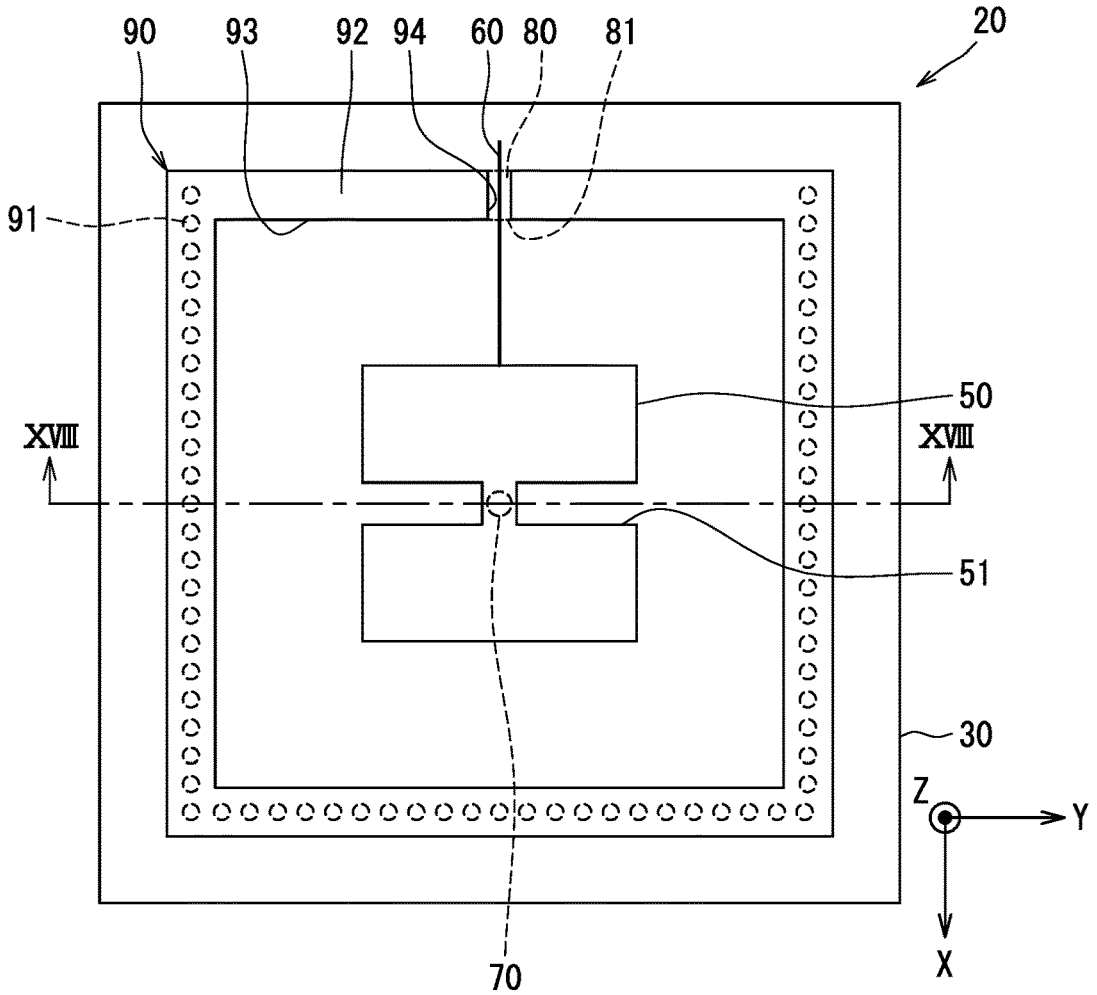
FIG. 17 is a plan view showing a modification example.
Figure 18:
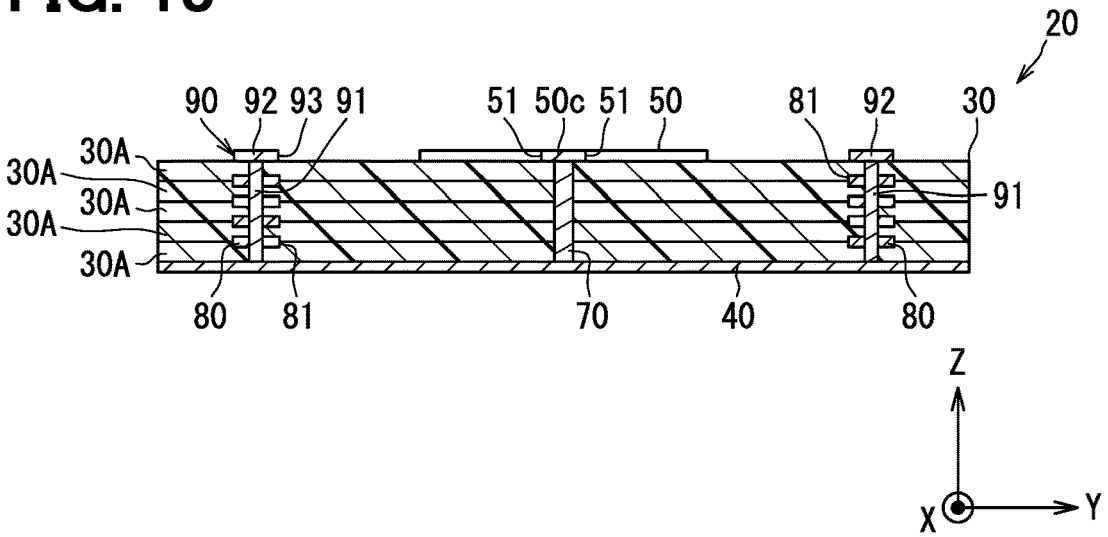
FIG. 18 is a cross-sectional view taken along a line XVIII-XVIII of FIG. 17.

As in a second modification example shown in FIGS. 17 and 18, a part of the shield wall 90 may be arranged on an arrangement surface of the opposed conductor 50. FIG. 17 corresponds to FIG. 15. FIG. 18 is a cross-sectional view taken along a line XVIII-XVIII of FIG. 17. The shield wall 90 has a surface conductor 92 arranged on the upper surface of the base material 30 in addition to the columnar part 91. Like the opposed conductor 50, the surface conductor 92 is formed by patterning/cropping a metal foil. The configuration other than the surface conductor 92 is the same as the modification example shown in FIG. 15.

The surface conductor 92 substantially matches the intermediate conductor 80 in a plan view. The surface conductor 92 has a penetration part 93 that substantially matches the penetration part 81 in a plan view. The penetration part 93 penetrates the surface conductor 92 in the Z direction. The penetration part 93 is a no-arrangement region of the conductor defined by the surface conductor 92. The surface conductor 92 further has a penetration groove 94. The penetration groove 94 is provided to avoid/circumvent the feeder line 60, and penetrates the surface conductor 92 in the Z direction. The penetration groove 94 may also be referred to as a gap between the surface conductors 92. The penetration groove 94 is connected to the penetration part 93. The surface conductor 92 has a flat, substantially C-shape. The penetration groove 94 and the surface conductor 92 substantially match the intermediate conductor 80 in a plan view.

The shield wall 90 may be provided so as to surround the opposed conductor 50. For example, in the configuration shown in FIG. 15 or 17, a plurality of columnar parts 91 may be provided on all the sides of the intermediate conductor 80 including a side toward which the feeder line 60 extends.

Other Embodiments

The disclosure in the present specification, drawing and the like is not limited to the exemplified embodiments. The present disclosure encompasses the exemplified embodiments and their modifications based on the embodiments by those skilled in the art. For example, the disclosure is not limited to the combinations of parts and/or elements shown in the embodiments. The present disclosure may be implemented in various combinations. The disclosure may have additional parts that may be added to the embodiment. The disclosure covers omissions of parts and/or elements of the embodiment. The disclosure covers replacement or combination of components, elements between one embodiment and the other. The disclosed technical scope is not limited to the description of the embodiments. It should be understood that disclosed technical scopes are shown by the description of the claims, and further include meanings equivalent to the description of the claims and all modifications within the scope.

The disclosure in the specification, drawings and the like is not limited by the description of the claims. The disclosures in the specification, the drawings, and the like encompass the technical ideas described in the claims, and further extend to a wider variety of technical ideas than those in the claims. Therefore, various technical ideas can be extracted from the disclosure of the present specification, the drawings and the like without being limited to the description of the claims.

Although an example in which the antenna device 20 is configured on the circuit board 11 has been shown, the present invention is not limited thereto. Although an example is shown in which the antenna device 20 includes the base material 30, the present invention is not limited thereto. The antenna device 20 may include at least the intermediate conductor 80 having the ground plate 40, the opposed conductor 50, the short-circuit part 70, and the penetration part 81.

The shapes of the ground plate 40 and the opposed conductor 50 in a plan view are not limited to the above-described examples. The shapes of the ground plate 40 and the opposed conductor 50 may be a substantially polygonal shape other than a rectangular shape or a substantially circular shape. The shape of the intermediate conductor 80 in a plan view is not limited to the above-described example. For example, the shape of the intermediate conductor 80 may be a substantially circular ring. The shape of the short-circuit part 70 is not limited to a circle/ring.

What is claimed is:

1. An antenna device comprising:

a ground plate providing a ground potential;

an opposed conductor separated a predetermined distance from the ground plate in a plate thickness direction of the ground plate, wherein the opposed conductor is configured for connection to a feeder line;

a short-circuit part electrically connecting the opposed conductor and the ground plate;

an intermediate conductor having a same potential as the ground plate and located between the ground plate and the opposed conductor in the plate thickness direction, wherein the intermediate conductor at least partly defines a penetration part that penetrates the intermediate conductor, and that includes the opposed conductor in a plan view in the plate thickness direction; and a base material containing a dielectric, wherein the ground plate, the opposed conductor, and the intermediate conductor are arranged at different positions of the base material in elevations of the plate thickness direction, the ground plate, the opposed conductor, the short-circuit part, and the intermediate conductor are a part of the base material in the plan view and are arranged in a region including a board end part, and the penetration part is a notch defined by the intermediate conductor and the board end part.

2. The antenna device of claim 1, wherein in one direction orthogonal to the plate thickness direction, the intermediate conductor is arranged on one side with respect to the opposed conductor, and the board end part is positioned on a side opposite to the intermediate conductor, and in the one direction, a distance from the opposed conductor to the board end part is longer than a distance from the opposed conductor to the intermediate conductor.

3. The antenna device of claim 1, wherein the opposed conductor has a predetermined depth in the plate thickness direction, and has a slit that opens on a side surface of the opposed conductor.

4. The antenna device of claim 1, wherein the penetration part has a rectangular shape in the plan view, and the length in the direction along each side of the rectangle is one half wavelength or less of an operation frequency.

5. An antenna device comprising:

a ground plate;

a first dielectric plate located above the ground plate;

a first intermediate conductor located above the first dielectric plate;

a second dielectric plate located above the first intermediate conductor;

a second intermediate conductor located above the second dielectric plate;

a third dielectric plate located above second intermediate conductor;

an opposed conductor located above the third dielectric plate; and a short circuit part electrically connecting: the ground plate, the intermediate conductors, and the opposed conductor, wherein the first intermediate conductor includes a first penetration part defined as a notch or a through hole in the first intermediate conductor, wherein the second intermediate conductor includes a second penetration part substantially identical to the first penetration part, wherein the opposed conductor is sized and located such that, in a plan view, a perimeter of the opposed conductor is completely surrounded by: a perimeter of the first dielectric plate, a perimeter of the second dielectric plate, and a perimeter of the third dielectric plate, wherein the short circuit part passes vertically through the first penetration part and through the second penetration part.

6. The antenna device of claim 5, wherein, in a plan view:

the first penetration part is a rectangular notch beginning on a front edge of the first intermediate conductor;

the opposed conductor is substantially square; and the short circuit part is substantially circular and substantially located at a center of the opposed conductor.

7. The antenna device of claim 5, wherein, in a plan view:

the first penetration part is a substantially rectangular through hole, such that a perimeter of the first penetration part is completely surrounded by: the perimeter of the first dielectric plate, the perimeter of the second dielectric plate, and the perimeter of the third dielectric plate;

the opposed conductor is substantially square; and the short circuit part is substantially circular and is substantially located at a center of the opposed conductor.

8. The antenna device of claim 5, wherein, in a plan view:

the first penetration part is a rectangular notch beginning on a front edge of the first intermediate conductor;

the opposed conductor includes a rear slit opening rearward, and a front slit opening frontward;

the left slit is a substantial mirror image of the right slit relative to a left-right axis passing through the short-circuit part, the short-circuit part is located between the rear slit and the front slit, and the short circuit part is substantially circular and substantially located at a center of the opposed conductor.

9. The antenna device of claim 5, further comprising:

a shield wall including columnar parts electrically connecting the intermediate conductors to the ground plate, wherein, in a plan view, the opposed conductor does NOT overlap any of the intermediate conductors.

* * * * *